US010021487B2

(12) United States Patent
Yan et al.

(10) Patent No.: US 10,021,487 B2
(45) Date of Patent: Jul. 10, 2018

(54) HEADSETS WITH EXTERNAL SPEAKERS WITH PREDETERMINED SHAPES AND DESIGNS

(71) Applicants: Wenqing Yan, Berkeley, CA (US); Victoria Hu, Berkeley, CA (US)

(72) Inventors: Wenqing Yan, Berkeley, CA (US); Victoria Hu, Berkeley, CA (US)

(73) Assignee: Axent Wear Inc., Torrance, CA (US)

( * ) Notice: Subject to any disclaimer, the term of this patent is extended or adjusted under 35 U.S.C. 154(b) by 0 days.

(21) Appl. No.: 14/491,934

(22) Filed: Sep. 19, 2014

(65) Prior Publication Data

US 2016/0088383 A1 Mar. 24, 2016

(51) Int. Cl.

| | |
|---|---|
| ***H04R 5/033*** | (2006.01) |
| ***H04R 1/02*** | (2006.01) |
| *H04R 1/10* | (2006.01) |
| *H04R 5/02* | (2006.01) |

(52) U.S. Cl.

CPC ..... *H04R 5/0335* (2013.01); *H04R 1/028* (2013.01); *H04R 1/1041* (2013.01); *H04R 5/02* (2013.01); *H04R 2420/07* (2013.01)

(58) Field of Classification Search

CPC ..... H04R 1/1066; H04R 1/1075; H04R 1/02; H04R 5/0335; H04R 1/1041; H04R 5/02

See application file for complete search history.

(56) References Cited

U.S. PATENT DOCUMENTS 4,173,715 A * 11/1979 Gosman ..... H04R 1/1058 181/129
4,309,575 A * 1/1982 Zweig ..... H04R 1/1066 381/151
5,095,382 A * 3/1992 Abe ..... H04B 10/114 320/107
5,684,879 A * 11/1997 Verdick ..... H04R 1/1075 381/300
6,483,925 B1 * 11/2002 Shen ..... H04R 1/105 381/370
6,944,309 B2 * 9/2005 Terai ..... H04R 5/033 381/309

(Continued)

FOREIGN PATENT DOCUMENTS

KR 20-2010-0007476 7/2010
WO WO 2012000042 A1 * 1/2012 ..... H04R 1/1091

OTHER PUBLICATIONS

Rokusu, Cool Nekomimi Headphones Are Here! Share Music With Nekomimi Loaded with Speakers!, Jul. 4, 2014, Tokyo Otaku Mode Otaku News, pp. 1-6.*

(Continued)

*Primary Examiner* — Fan Tsang
*Assistant Examiner* — Angelica M McKinney
(74) *Attorney, Agent, or Firm* — DLA Piper LLP (US)

(57) ABSTRACT

Disclosed herein is a headset, comprising a headband-like component, one or two external ear pieces, and one or more external speakers. The headband-like component comprises a first end and a second end. Each ear piece of the one or two external ear pieces covers one ear of a user and is connected to one of the first end and second end of the headband-like component. Each external speaker of the one or more external speakers has a predetermined design and each external speaker is mounted on the headband-like component.

35 Claims, 11 Drawing Sheets

(56) References Cited

U.S. PATENT DOCUMENTS

| | | | | |
|---|---|---|---|---|
| 7,319,762 | B2 * | 1/2008 | Andrea | H04R 1/1041 340/815.46 |
| 8,000,486 | B2 * | 8/2011 | Hildebrandt | H04R 1/1075 381/309 |
| 8,605,931 | B2 | 12/2013 | Amsel | |
| 8,625,833 | B1 * | 1/2014 | Armwood | 381/370 |
| 9,832,560 | B1 * | 11/2017 | Bagga | H04R 1/1041 |
| 2004/0032964 | A1 * | 2/2004 | Liang | H04R 5/0335 381/370 |
| 2006/0233388 | A1 * | 10/2006 | Liow | H04R 1/1041 381/74 |
| 2007/0047740 | A1 * | 3/2007 | Andrea | H04R 1/1041 381/74 |
| 2009/0041267 | A1 | 2/2009 | Lee | |
| 2012/0099755 | A1 | 4/2012 | Hu | |
| 2013/0237867 | A1 * | 9/2013 | Alexander | G06F 3/015 600/509 |
| 2014/0126755 | A1 | 8/2014 | Strasberg | |
| 2014/0341415 | A1 * | 11/2014 | Camello | H04R 1/10 381/379 |
| 2015/0071456 | A1 * | 3/2015 | Steenkamp | H04R 1/1008 381/74 |
| 2016/0057538 | A1 * | 2/2016 | Clark | H04R 3/12 381/77 |
| 2017/0272852 | A1 * | 9/2017 | Kamada | H04R 1/1075 |

OTHER PUBLICATIONS

Korean Intellectual Property Office, Notification of Transmittal of the International Search Report and the Written Opinion of the International Searching Authority, dated Jan. 6, 2016.

Yuumei: "Axent Wear Cat Ear Headphones FAQ" retrieved from the internet https://yuumei.deviantart.com/journal/Axent-Wear-Cat-Ear-Headphones-FAQ-460807698 (3 pgs.)

Yuumei: "Cat Ear Headphones" retrieved from the internet https://yuumei.deviantart.com/art/Cat-Ear-Headphones-191107600 (18 pgs.)

* cited by examiner

HEADSETS WITH EXTERNAL SPEAKERS WITH PREDETERMINED SHAPES AND DESIGNS

CROSS-REFERENCE TO RELATED APPLICATIONS

This application claims priority to U.S. Design application No. 29/495,826, filed on Jul. 3, 2014 and entitled "HEADSET WITH SPEAKERS SHAPED AS ANIMAL EARS," which is issued as Pat. No. D757,679 and hereby incorporated herein by reference in its entirety.

FIELD OF THE INVENTION

The invention relates to a headset. In particular, the invention relates to a headset comprising built-in external speakers. More specifically, the invention relates to a headset comprising built-in external speakers with predetermined shapes and designs, such as animal ears.

BACKGROUND

Portable electronic devices such as portable CD or DVD players, MPEG players, MP-3 players, and cell phones have become most popular over the past decades. These devices provide a variety of forms of personal entertainment, allowing users to enjoy conversation, music and movie independent of locations and resources. For many portable electronic devices, it is necessary or desirable to have a headset to provide user privacy while avoiding disturbance to others.

Existing headsets typically have one or more speakers, which may be in the form of one or two earplugs that can be placed in the ears or enclosed/embedded in muff-like structures covering the ears. What is needed in the art are designs and functionalities to improve functionalities and create individualities in headsets.

SUMMARY OF THE INVENTION

Provided herein is a headset, comprising a headband-like component, one or two external ear pieces, and one or more external speakers. The headband-like component comprises a first end and a second end. Each ear piece of the one or two external ear pieces covers one ear of a user and is connected to one of the first end and second end of the headband-like component. Each external speaker of the one or more external speakers has a predetermined design and each external speaker is mounted on the headband-like component.

In some embodiments, the predetermined design is selected from the group consisting of a cat ear, a bear ear, a hare ear, a horoscope design, a zodiac design, a non-ear shaped design, a flower, a star, a leaf, a Christmas tree design, and combinations thereof.

In some embodiments, the headset comprises only one external ear pieces. In some embodiments, the headset comprises two external speakers.

In some embodiments, each of the one or two external ear pieces has a decorative element on the side that is opposite to the side coving the ear. In some embodiments, the decorative element comprises one or more light emitting diode (LED) rings. In some embodiments, at least one of the one or more LED rings on the external ear pieces is synchronized with the music when the headset is used to listen to music.

In some embodiments, each of the one or more external speakers has a decorative element. In some embodiments, the decorative element comprises one or more light emitting diode (LED) rings. In some embodiments, at least one of the one or more LED rings on the external ear pieces is synchronized with the music when the headset is used to listen to music.

In some embodiments, the headset further comprises one or more control button on the headband-like component.

In some embodiments, the headset further comprises one or more control button on the one or more external ear pieces.

In some embodiments, the headset further comprises one or more control button on the one or more external speaker.

In some embodiments, the headset further comprises an audio cable for receiving audio signals from an external device.

In some embodiments, the headset further comprises a wireless communication unit for receiving audio signals wirelessly from an external device. In some embodiments, the wireless communication unit is located in one selected from the group consisting of a headband-like component, an external ear pieces, an external speakers, and combinations thereof.

Also provided herein are methods of using headsets. For example, a user can choose to listen to music privately via the headset or to broadcast the music to share with friends via the external speakers.

It will be understood that any suitable embodiments can be combined to suite a particular purpose.

BRIEF DESCRIPTION OF THE DRAWINGS

Those of skill in the art will understand that the drawings, described below, are for illustrative purposes only. The drawings are not intended to limit the scope of the present teachings in any way.

DETAILED DESCRIPTION OF THE INVENTION

Definitions

Unless otherwise noted, terms are to be understood according to conventional usage by those of ordinary skill in the relevant art.

A headset disclosed herein comprises a headband-like component and one or more ear pieces. In one aspect, headsets described herein also comprise one or more external speakers. In one aspect, headsets described herein also comprises one or more external speakers with decorative elements such as LED light circles or LED lights arranged in other patterns. In another aspect, headsets described herein further comprises decorative elements such as LED light decorations on the external ear pieces.

Figure 1:
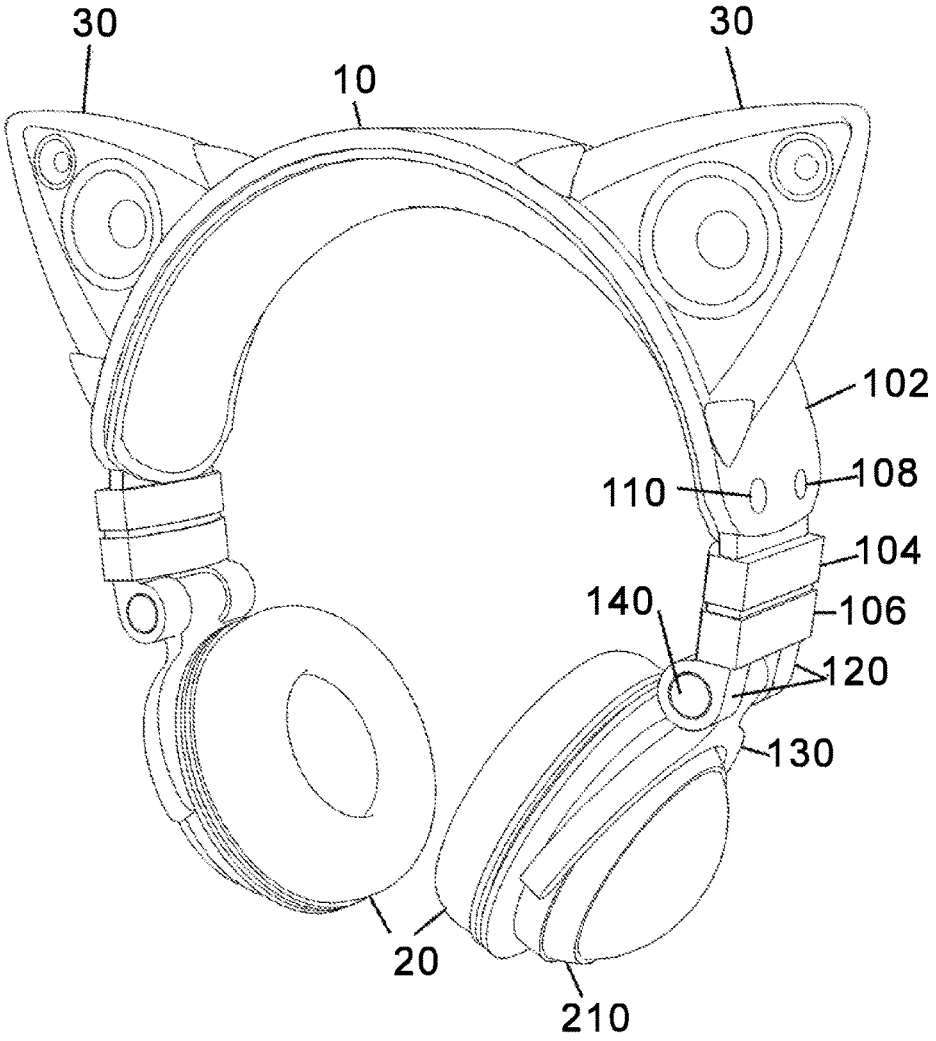
FIG. 1 depicts an exemplary embodiment in front perspective view.
Figure 2:
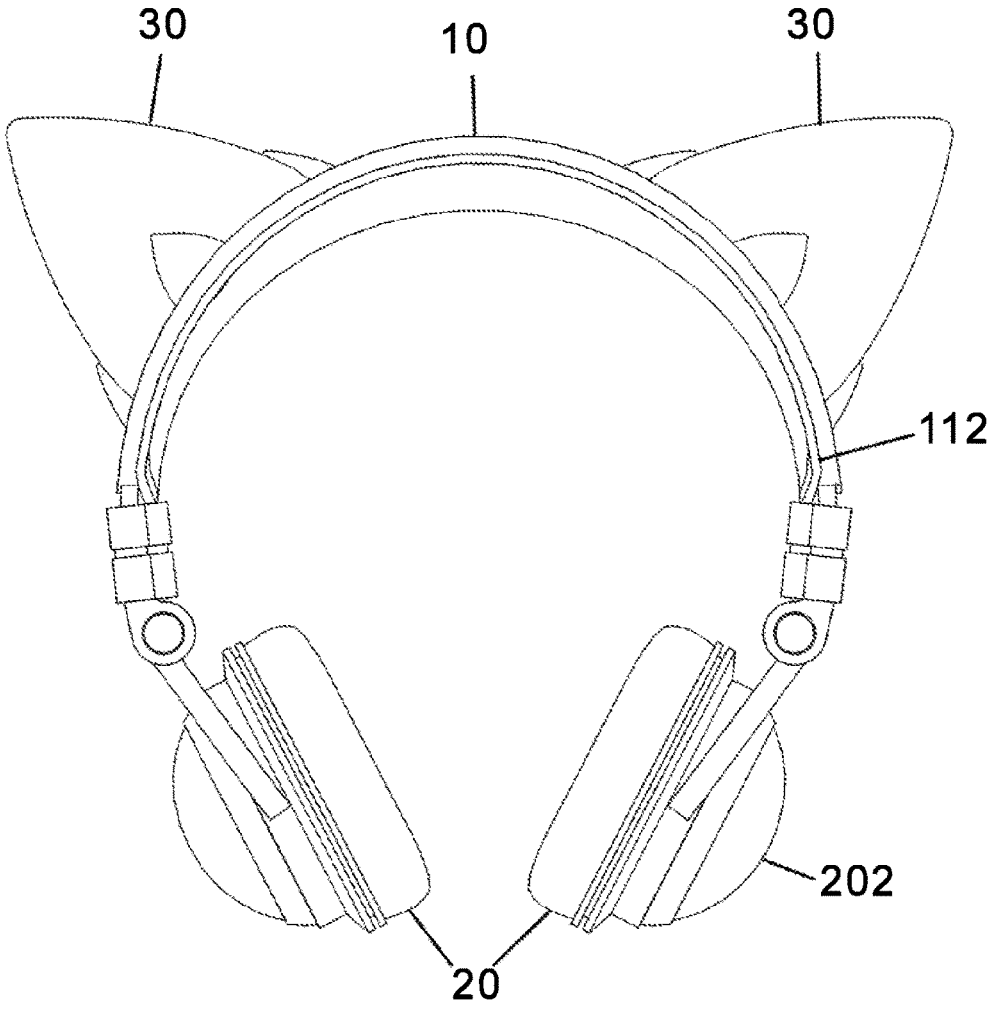
FIG. 2 depicts an exemplary embodiment, viewed from the back.
Figure 3:
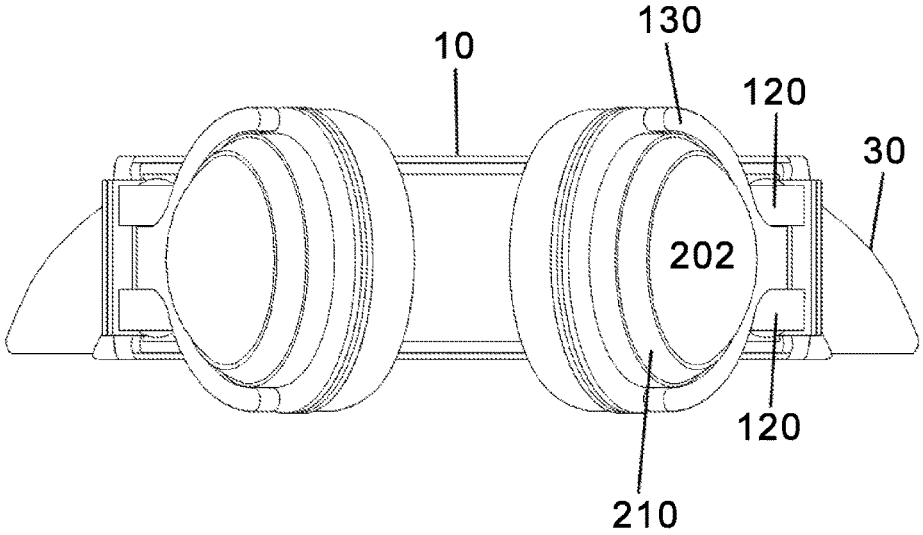
FIG. 3 depicts an exemplary embodiment, viewed from the bottom.

Referring to FIG. 1, headset 100 comprises headband-like component (e.g., element 10), one or more external ear pieces (e.g., muff-like element 20) and two external speakers (e.g., element 30) attached to the headband. Description is provided herein as illustration for understanding of the invention and should in no way limit the scope of the invention.

Any suitable configurations in existing headsets can be used to incorporate the external speakers described herein, for example, including but not limited to U.S. Design Pat. No. D552077; U.S. Design Pat. No. D698749; U.S. Pat. No. 5,095,382; U.S. Pat. No. 5,333,206; U.S. Pat. No. 6,236,732; U.S. Pat. No. 7,146,199; U.S. Pat. No. 8,045,726; U.S. Pat. No. 8,050,444; US Pat. Pub. No. 2011/0268290; US Pat. Pub. No. 2011/0126846; US Pat. Pub. No. 2012/0243703; US Pat. Pub. No. 2012/0308067; and US Pat. Pub. No. 2014/0177897; each of which is incorporated herein by reference in its entirety.

Headband Component 10

Headband-like component 10 comprises a curved piece with two ends (e.g., element 102 in FIG. 1). The curved piece is shaped according to the shape of a user's head to provide fit and comfort. Headband-like component 10 is the center piece and provides structural support for the entire device. For example, it serves as the base to which the external speakers 30 are attached. Additionally, the external ear pieces are also attached to the two ends of the headband component. In addition, headband-like component 10 provides electrical contacts and connections to both ear pieces 20 and external speakers 30.

When the headset is in use, in some embodiments, headband-like component 10 goes over the top of head of the user. In some embodiments, the headband-like component goes over the back of the head of the user. In some embodiments, the headband-like component goes over between the top and the back of the head of the user.

In some embodiments, two ends of the headband-like component are symmetrically located on the user's. In such embodiments, one or both ends of the headband-like component are connected with an external ear piece. In some embodiments, two ends of the headband-like component are not symmetrically located. In such embodiments, only the longer of the two ends is connected with an external ear piece. The shorter end does not have an external ear piece and accordingly does not reach the ear. However, it extends far enough to provide structural support. In some embodiments, the design includes a microphone. In some embodiments, no microphone is needed. Exemplary designs include but are not limited to the design disclosed in, for example, U.S. Pat. No. D299643; U.S. Pat. No. 7,920,903; U.S. Pat. No. D337116; U.S. Pat. No. D376598; U.S. Pat. No. D481375; and US Pat. Pub. No. 2011/0143820; each of which is hereby incorporated by reference in its entirety.

Figure 5:
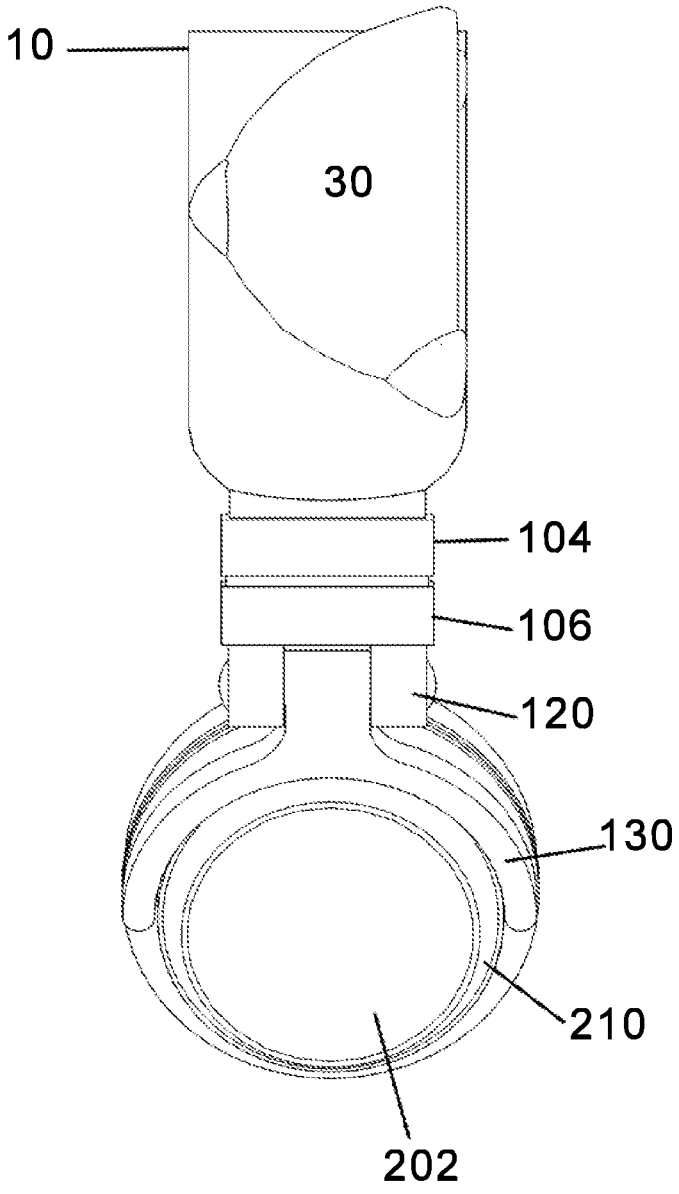
FIG. 5 depicts an exemplary embodiment, viewed from one side.
Figure 6:
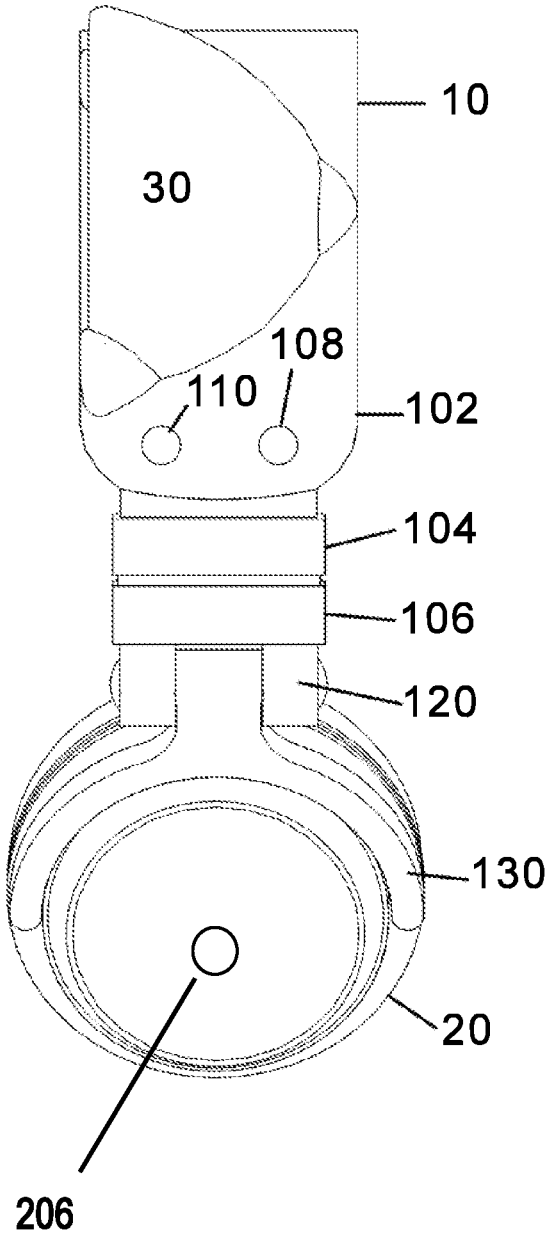
FIG. 6 depicts an exemplary embodiment, viewed from the other side.
Figure 7A:
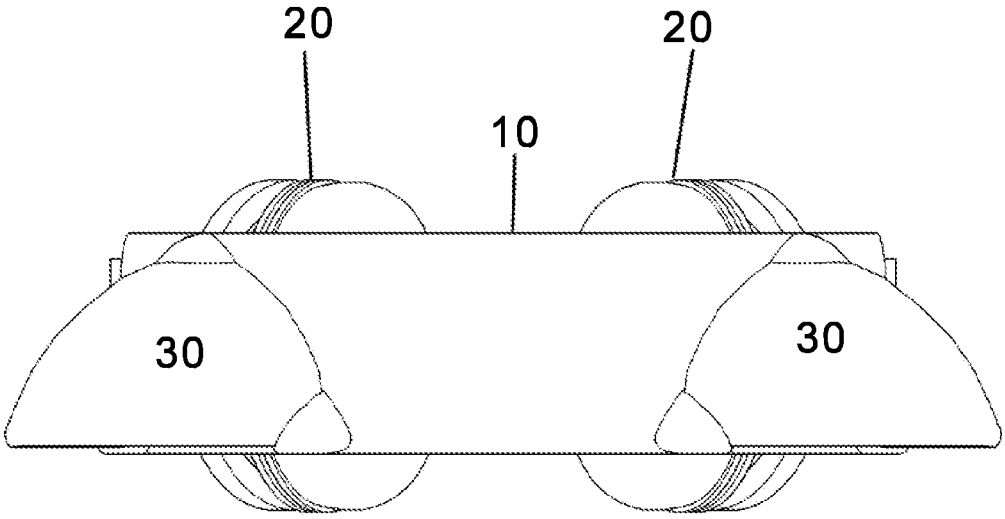
FIG. 7A depicts an exemplary embodiment, viewed from the top.
Figure 7B:
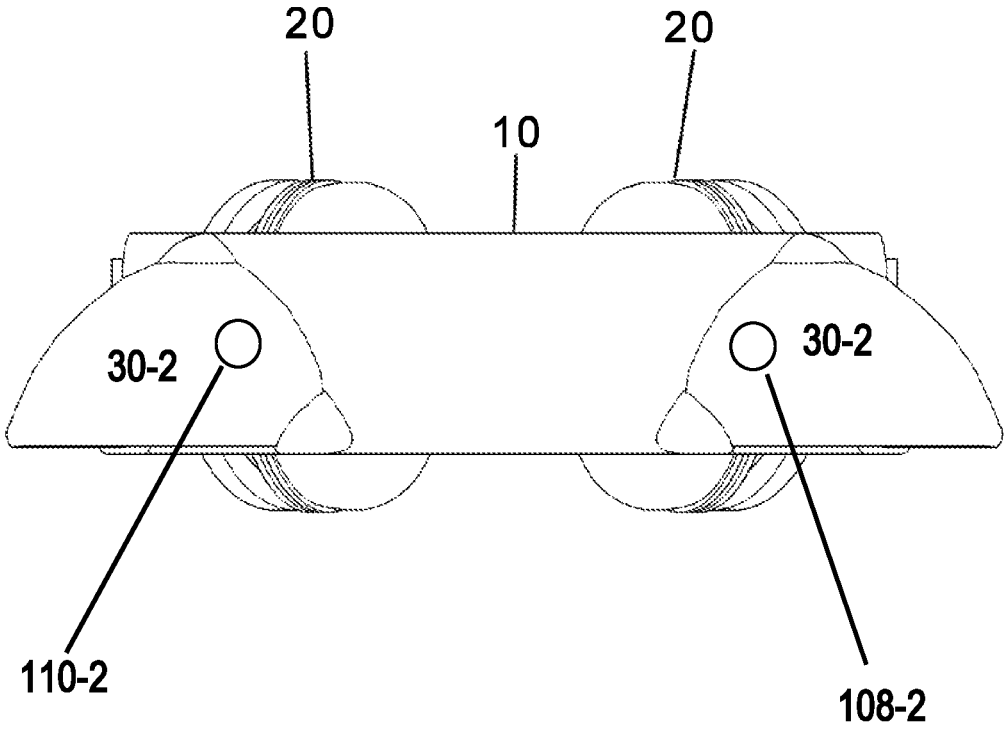
FIG. 7B depicts an alternative exemplary embodiment, viewed from the top.

The curved piece of the headband-like component has two sides. In some embodiments, the side that is in contact with a user's head is padded for comfort. On the opposite side that is not in contact with a user's head, one or more external speakers are attached. One of skill in the art would understand that any suitable configurations can be used for the headband-like component so long as they allow accommodation of the external speakers and connection to the ear pieces. For example, in some embodiments, the headband-like component has even width and parallel edges, as depicted in FIGS. 5 and 6. In some embodiments, the headband-like component has uneven width or un-parallel edges.

Detailed description concerning the attachment and configuration of the speakers can be found in the section entitled external speakers. Any suitable materials can be used in the headband-like component.

In some embodiments, the size of the headband-like component can be adjusted to adopt to particular users, for example, by using an extendible mechanism. For example, the relative position of elements 104 and 106 can be adjusted such that the size of the headband-like component is varied to fit a user's head.

External Ear Piece 20

One or two external ear pieces (e.g., element 20 in FIG. 1) are attached to one or both ends of the headband-like component 10. In preferred embodiments, an external ear muff-like ear piece is attached to each end of headband-like component 10 via a rotatable mechanism. For example, as illustrated in FIG. 1, an ear muff-like ear piece 20 is held by a fork-like structure 130. One end of the fork-like structure is connected with element 120 at one end of headband-like component 10. The entire ear piece 20 can be rotated around the axis of element 140. In some embodiments, entire ear piece 20 is folded against the inside of headband-like element 10 to allow compact packing of the headset.

Conventional design, although the internal ear piece electronics are connected to the speakers' wiring so that music can be synced and turned on or off.

In some embodiments, external ear pieces 20 have one or more built-in speakers. In some embodiments, audio signals are directly transmitted to a built-in speaker via wired connection. In some embodiments, audio signals are directly transmitted to the built-in speaker via wireless connection; for example, via Bluetooth™ connection. In some embodiments, audio signals are fed simultaneously to the built-in speakers in the ear pieces and the external speakers. In some embodiments, a user can also choose to direct audio signals to only the built-in speakers in the ear pieces or the external speakers.

Figure 4:
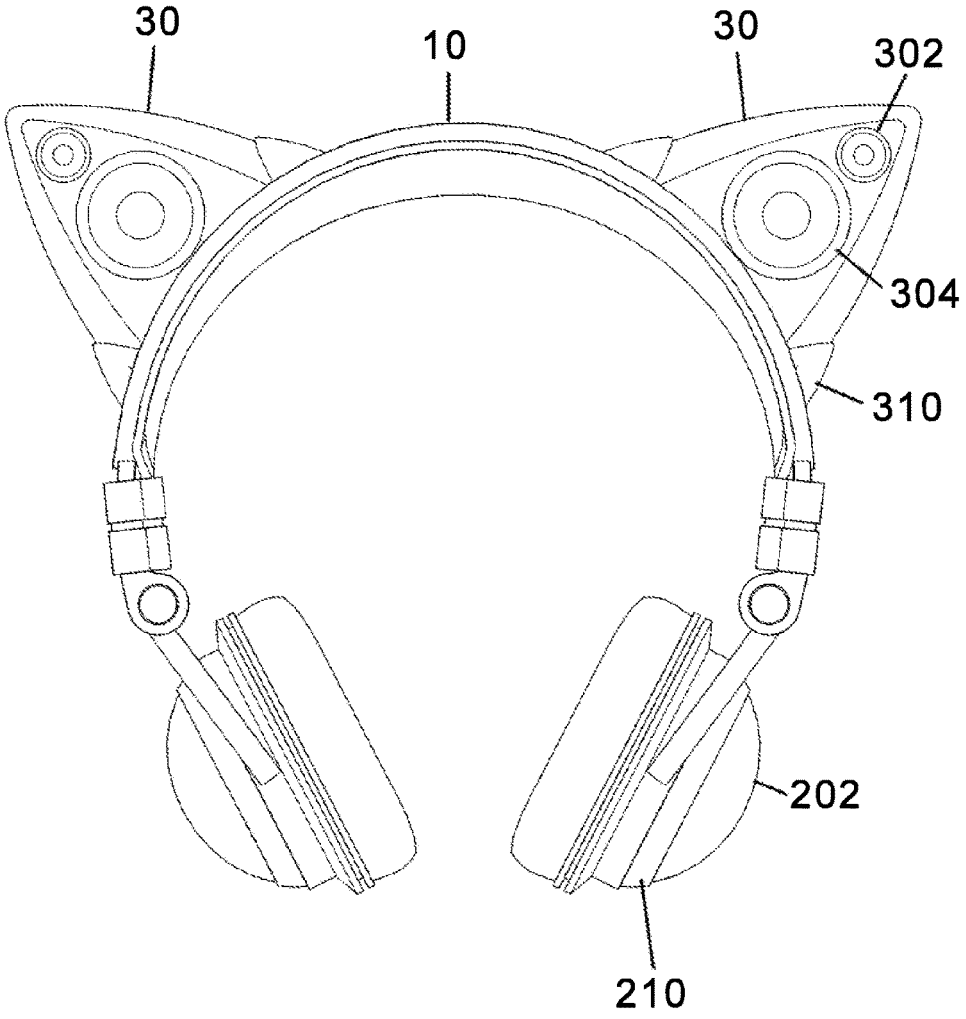
FIG. 4 depicts an exemplary embodiment, viewed from the front.

In some embodiments, decorative elements such as LED lights 210 are positioned on or embedded in one or both ear pieces; for example, on the dome-like element 202 (e.g., FIGS. 4 and 5). The LED lights can be arranged in any shape or pattern; e.g., a ring (see element 210 in FIGS. 1, and 3-5), a band, a sparkle, a star or any other shapes or designs. In some embodiments, the LED lights stay steady once they are turned on. In some embodiments, the LED lights flicker or flash. In some embodiments, the LED lights flicker or flash in accordance with a feature of the audio signals such as the beat or rhythm of the music. LED lights used here can have one or multiple colors. In some embodiments, the same LED light changes colors. In some embodiments, the same LED light changes colors according to a feature of the audio signals such as the rhythm or beat of a music piece. In some embodiments, different LEDs having different colors are used.

In some embodiments, headset has two or more modes of operation. A user can use one or more built-in switches to select the desired mode for personal enjoyment or sharing with others. For example, switches (e.g., control buttons) can be positioned near one or both ends of the headband-like component (e.g., elements 108 and 110 in FIG. 1). In some embodiments, a switch is used to turn LED lights on and off. In some embodiments, a switch is used to cause the LED lights to enter a flashing mode. In some embodiments, a switch is used to change the color of the LED lights. In some embodiments, a switch is used to direct audio signals to earphone, external speakers or both.

Figure 9:
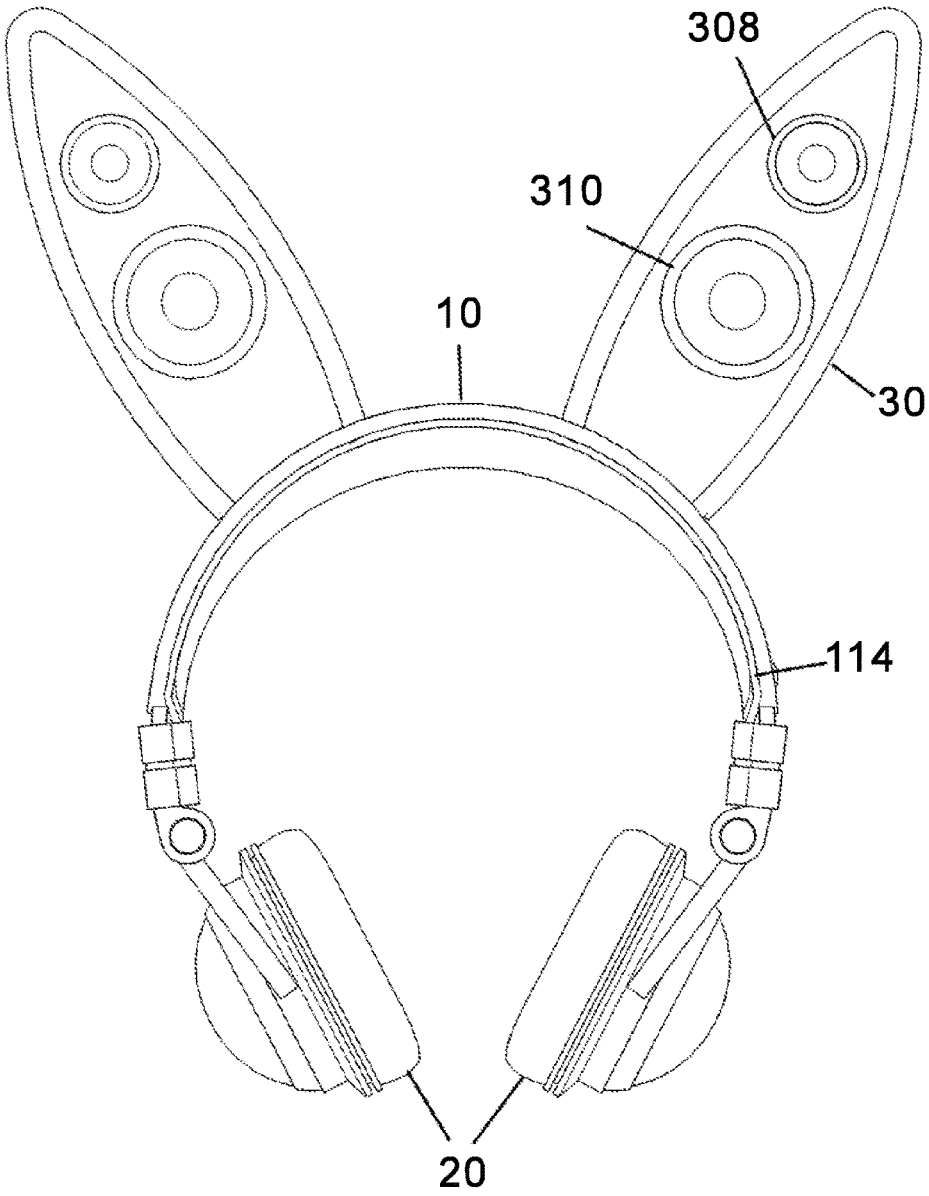
FIG. 9 depicts an exemplary embodiment having external speakers in different shape.

Referring to FIGS. 1 and 9, ear pieces 20 are connection via, for example, cable 112 or 114. In some embodiments, the cable is concealed (e.g., entirely or partially within the headband-like component).

External Speaker 30

A headset disclosed herein comprises one or more external speakers having predetermined shapes and designs, including but not limited to animal ears (e.g., FIGS. 1-10). In preferred embodiments, a headset disclosed herein comprise two external speakers symmetrically positioned on the headband-like piece, as depicted in FIGS. 1 through 10.

Exemplary speaker designs include but are not limited to cat ears, bear ears, bunny ears, mouse ears, Mickey or Minnie Mouse ears, or any other designs. In some embodiments, an external speaker in accordance with the present invention adopts a non-ear shaped design such as a flower, a star, a leaf, a Christmas tree and etc. In some embodiments, the external speakers have shapes and designs representing different horoscopes or different Chinese zodiacs.

In some embodiments, speakers connected to the same headband-like components have the same shapes and designs. In some embodiments, speakers connected to the same headband-like components have different shapes and designs.

The present invention sets no limitation on the number of speakers used. In some embodiments, one speaker is used (e.g., a unicorn horn). In preferred embodiments, two speakers are used. In some embodiments, three or more speakers are used; e.g., arranged in an array on the headband-like component. In some embodiments, four or more speakers are used. In some embodiments, five or more speakers are used. In some embodiments, six or more speakers are used. In some embodiments, ten or more speakers are used.

In some embodiments, external speakers with predetermined shapes and designs are permanently attached to the headband-like component. In some embodiments, external speakers with predetermined shapes and designs can be detached from the headband-like component. In some embodiments, the same attachment method is used to attached different external speakers to the headband-like component. As such, different external speakers are interchangeable.

Figure 10:
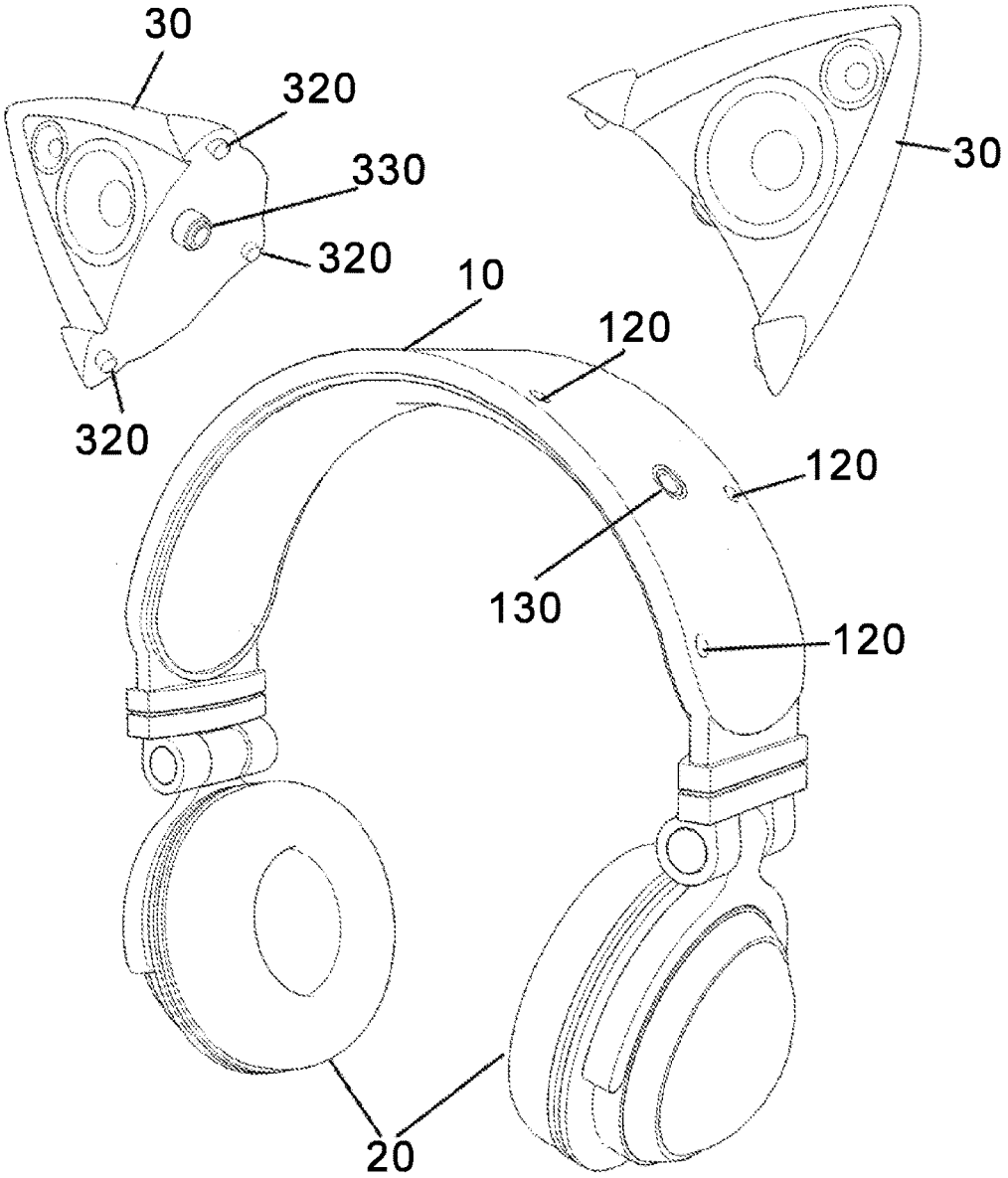
FIG. 10 depicts an exemplary embodiment, which shows the external speakers in detached mode.

Referring to FIG. 10, cat ear shaped speakers 30 are shown detached from the headband-like component 10. For example, electrical element 360 on each speaker 30 is connected with the corresponding electrical element 160 on headband-like component 10. The connection between 360 and 630 permits audio signals to be transferred into the speakers. One of skill in the art would understand that all types of electrical elements that can facilitate the transfer of signals such as audio signals can be used. In some embodiments, multiple electrical elements are used, including but not limited to, for example, 2 or more, 3 or more, 4 or more, 5 or more, 6 or more, 10 or more, 15 or more, 20 or more, 30 or more elements.

Additionally, one or more structural attachment elements (e.g., elements 350 on speaker 30 in FIG. 10) are used to securely attach the speakers to headband-like component 10 via corresponding receiving elements (e.g., elements 150 on headband-like component 10). One of skill in the art would understand that all types of attachment elements that can securely attach the speakers to the headband-like component can be used. In some embodiments, multiple attachment elements are used, including but not limited to, for example, 2 or more, 3 or more, 4 or more, 5 or more, 6 or more, 10 or more, 15 or more, 20 or more, 30 or more elements.

In some embodiments, the attachment between attachment elements 350 and receiving elements 150 is reversible. In some embodiments, speakers have different shapes and designs (e.g., bear ears, bunny ears, mouse ears and etc.) but use the same attachment elements. As such, speakers of different shapes and designs become interchangeable: a user can remove a speaker and replace it with a speaker with different shapes and designs by taking advantage of the common attachment motif.

Any speakers can be used, regardless of the number of drivers, pole type, enclosure type, or other characteristics. In some embodiments, external speakers 30 are passive speakers. Such speakers do not have built-in amplifiers: the audio signals have been amplified enough to drive the speakers sufficiently. In some embodiments, external speakers 30 are active speakers. Audio signals received at the speakers are actively processed and broadcasted. For example, known weakness of the external speakers are compensated by built-in mechanism (e.g., a built-in amplifier or a computer chip). In some embodiments, the built-in mechanism enhances the base component of the audio signals. Such active speakers are fed by a low-level (line-level) signal passed along an interconnect cable originating at your preamplifier or controller. Further, the amplifier is an active electronic device and the active speakers need power and are electricity consuming.

Figure 8:
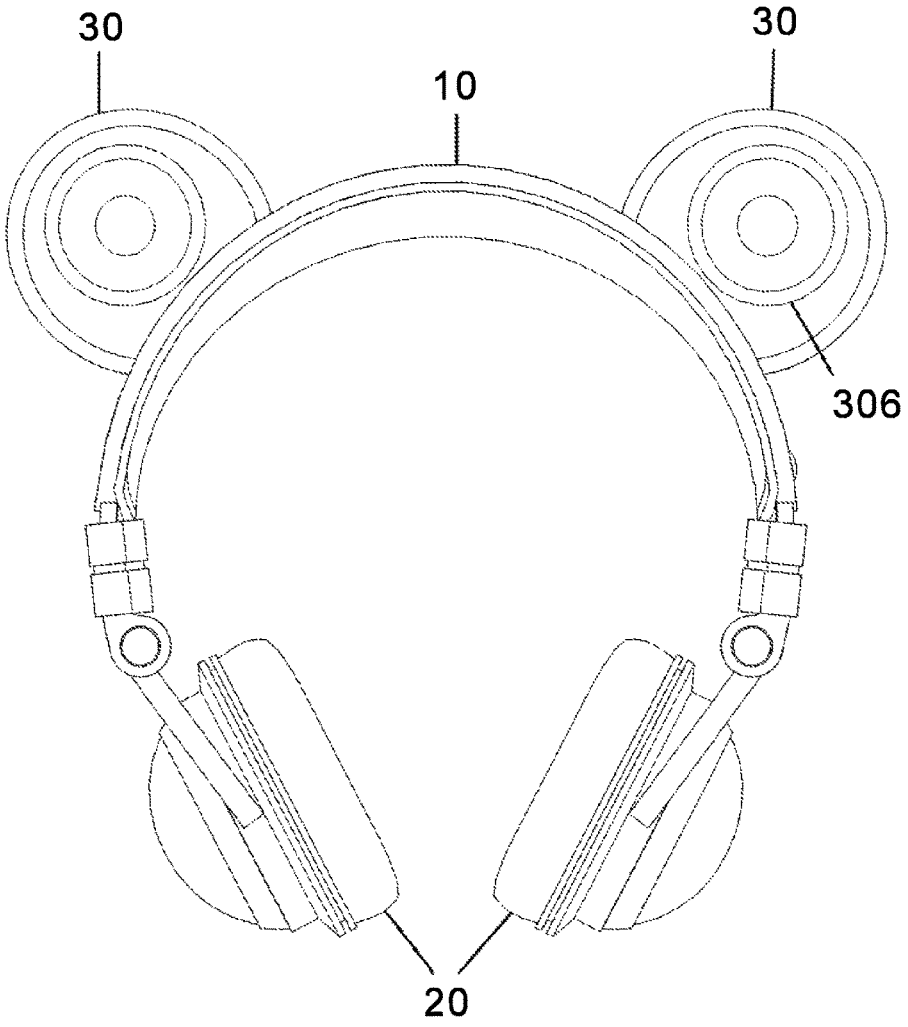
FIG. 8 depicts an exemplary embodiment having external speakers in different shape.

In some embodiments, an external speaker in accordance with the present invention has decorative elements such as LED lights are positioned on or embedded in one or both external speakers; for example, on the face of speakers 30 (see, e.g., elements 302 and 304 in FIG. 4; element 306 in FIG. 8; and elements 308 and 310 in FIG. 9). LED lights can be arranged in any shape or pattern; e.g., a ring, a band, a sparkle, a star or any other shapes or designs. In some embodiments, the LED lights stay steady once they are turned on. In some embodiments, the LED lights flicker or flash. In some embodiments, the LED lights flicker or flash in accordance with a feature of the audio signals such as the beat or rhythm of the music. LED lights used here can have one or multiple colors. In some embodiments, the same LED light changes colors. In some embodiments, the same LED light changes colors according to a feature of the audio signals such as the rhythm or beat of a music piece. In some embodiments, different LEDs having different colors are used.

A user can use one or more built-in switches to select the desired mode for personal enjoyment or sharing with others. For example, switches (e.g., control buttons) can be positioned near one or both external speakers; see 108-2 and 110-2 in FIG. 7B. In some embodiments, a switch is used to turn LED lights on and off. In some embodiments, a switch is used to cause the LED lights to enter a flashing mode. In some embodiments, a switch is used to change the color of the LED lights. In some embodiments, a switch is used to direct audio signals to earphone, external speakers or both.

In some embodiments, a switch is used to cause the LED lights to flash in synchronization with a feature of the audio signal (e.g., the rhythm or beat of a music piece). In some embodiments, a switch is used to cause the LED lights to change in synchronization with a feature of the audio signal (e.g., the rhythm or beat of a music piece). In some embodiments, multiple switches are used. In some embodiments, the same switch can be used to change between different mode of operations: for example, pushing a button once corresponds to the LED flash synchronization functionality and pushing the button twice consecutively corresponds to the LED color change functionality.

Referring to FIGS. 4, 8 and 9, LED lights can be arranged according to the shape and design of the external speakers themselves. In some embodiments, there is only one LED light ring in FIG. 8. In other embodiments, two or even more LED light rings are used. In the three examples, the LED light rings outline the shape of the speakers. In some embodiments, LED lights of other shapes and arrangements can be used.

Additional decorative or functional elements can be used in conjunction with or independent of LED lights. For example, in FIG. 4, elements 350 are used to secure the speakers and to add additional characteristics to speakers and headset.

In some embodiments, a switch is used to cause the LED lights on the ear pieces to flash in synchronization with a feature of the audio signal (e.g., the rhythm or beat of a music piece). In some embodiments, a switch is used to cause the LED lights to change in synchronization with a feature of the audio signal (e.g., the rhythm or beat of a music piece). In some embodiments, multiple switches are used. In some embodiments, the same switch can be used to change between different mode of operations: for example, pushing a button once corresponds to the LED flash synchronization functionality and pushing the button twice consecutively corresponds to the LED color change functionality.

In some embodiments, switches (e.g., control buttons) can be positioned on the external speakers to control the LED lights or change modes of operation for the external speakers. Such switches can be used independent from or in conjunction with control switches on the headband-like component. In some embodiments, a switch is used to turn LED lights on and off. In some embodiments, a switch is used to cause the LED lights to enter a flashing mode. In some embodiments, a switch is used to change the color of the LED lights. In some embodiments, switches (e.g., control buttons) are positioned on the external speakers as audio control. Such switches can also be used independent from or in conjunction with control switches on the headband-like component. In some embodiments, a switch is used to direct audio signals to external speakers.

In such embodiments, the speakers are in a broadcasting/group enjoyment mode. In some embodiments, a switch is used to turn off audio signals to external speakers and only direct signals to the ear pieces. In such embodiments, the speakers are in a personal enjoyment mode. In some embodiments, a switch is used to turn on or turn off audio signals to external speakers. In some embodiments, a switch is used to cause the LED lights to flash in synchronization with a feature of the audio signal (e.g., the rhythm or beat of a music piece).

In some embodiments, control buttons (e.g., elements 108 and 110 in FIG. 6) are located on the headband-like component. In some embodiments, control buttons (e.g., element 202 in FIGS. 2 and 3) are located on one or both ear pieces. In some embodiments, control buttons (e.g., elements 108-2 and 110-2 on speakers 30-2 in FIG. 7B) are located on one or each of the external speakers.

In some embodiments, one or more control buttons on an ear piece are used as alternatives to control buttons on an external speaker or headband-like component. In some embodiments, one or more control buttons on the ear pieces are used in addition to control buttons on external speakers or headband-like component.

In some embodiments, external speakers are powered by one or more batteries. In some embodiments, the one or more batteries are rechargeable. For example, the batteries can be charged through a plug-in motif on the external speaker.

In some embodiments, the speakers are directly powered by a power outlet.

Overall Appearance

Headsets in accordance with the presence invention can adopt any size or color to suit the preference of a particular use. For example, smaller designs, bright colors, and light-weight materials are used for headsets suitable for young children. When external speakers shaped as cat ears are used, different models can be design to suit users of different ages. For young girls, color scheme and design similar to those of Hello Kitty™ are used: all or part of the headset (headband-like component, ear pieces and external speakers) are pink and the design of the cat ear-shaped speakers is smooth and more round-shaped, similar to that of Hello Kitty™.

In some embodiments, components in a headset have the same color. In some embodiments, components in a headset have different colors. For example, the headband-like component is black; ear pieces are white or silver; and the external speakers are blue. In some embodiments, ear pieces have the same color. In some embodiments, ear pieces have different colors. In some embodiments, external speakers have the same color. In some embodiments, external speakers have different colors.

Applications and Functionalities

In one aspect, also provided are methods and ways by which a user can use the headsets disclosed herein.

In some embodiments, speakers in the ear pieces and external speakers are connected in parallel. Audio signals are fed into the ear pieces and external speakers at the same time and independent of each other. For example, audio signals from a portable device such as an iPhone are fed to both the ear pieces (e.g., the ear muff-like ear piece) and external speakers. In such embodiments, sound qualities in one speaker are not affected by the presence of other speakers. A user can turn one speaker on and off without affecting the performance of the other speakers. This configuration allows the user to switch between personal enjoyment mode and group enjoyment mode seamlessly. In some embodiments, speakers in the ear pieces and external speakers are connected in series. For example, audio signals pass from the external speakers first and then to the ear pieces.

Alternatively, audio signals pass from the ear pieces first and then to the external speakers. In such embodiments, the first speaker or first set of speakers function as one or more filters; e.g., if the audio signals are fed to the low quality speakers first, qualities of the audio signals will be reduced for the subsequent speakers. If the first speaker or first set of speakers are active speakers, they may enhance certain aspect of the audio signals to allow better listening experience at the subsequent filters.

In some embodiments, a user uses a cable to directly connect a portable device with the headset. In some embodiments, the portable device and the headset are connected wirelessly, for example, via Bluetooth™ connection (see element 204 in FIG. 6).

In some embodiments, a user wears the headset (wirelessly connected to the source of the music) to dance. In some embodiments, decorative elements such as LED lights flash or flicker when the headset is set in a dancing mode. In some embodiments, the LED lights flash or flicker with the rhythm or beat with the music.

In some embodiments, the headset is worn as a fashion statement.

Having described the invention in detail, it will be apparent that modifications, variations, and equivalent embodiments are possible without departing the scope of the invention defined in the appended claims. Furthermore, it should be appreciated that all examples in the present disclosure are provided as non-limiting examples.

The various methods and techniques described above provide a number of ways to carry out the invention. Of course, it is to be understood that not necessarily all objectives or advantages described may be achieved in accordance with any particular embodiment described herein. Thus, for example, those skilled in the art will recognize that the methods can be performed in a manner that achieves or optimizes one advantage or group of advantages as taught herein without necessarily achieving other objectives or advantages as may be taught or suggested herein. A variety of advantageous and disadvantageous alternatives are mentioned herein. It is to be understood that some preferred embodiments specifically include one, another, or several advantageous features, while others specifically exclude one, another, or several disadvantageous features, while still others specifically mitigate a present disadvantageous feature by inclusion of one, another, or several advantageous features.

Furthermore, the skilled artisan will recognize the applicability of various features from different embodiments. Similarly, the various elements, features and steps discussed above, as well as other known equivalents for each such element, feature or step, can be mixed and matched by one of ordinary skill in this art to perform methods in accordance with principles described herein. Among the various elements, features, and steps some will be specifically included and others specifically excluded in diverse embodiments.

Although the invention has been disclosed in the context of certain embodiments and examples, it will be understood by those skilled in the art that the embodiments of the invention extend beyond the specifically disclosed embodiments to other alternative embodiments and/or uses and modifications and equivalents thereof.

In some embodiments, the numbers expressing quantities of ingredients, properties such as molecular weight, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

In some embodiments, the terms "a" and "an" and "the" and similar references used in the context of describing a particular embodiment of the invention (especially in the context of certain of the following claims) can be construed to cover both the singular and the plural. The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It is contemplated that skilled artisans can employ such variations as appropriate, and the invention can be practiced otherwise than specifically described herein. Accordingly, many embodiments of this invention include all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

Furthermore, numerous references have been made to patents and printed publications throughout this specification. Each of the above cited references and printed publications are herein individually incorporated by reference in their entirety.

In closing, it is to be understood that the embodiments of the invention disclosed herein are illustrative of the principles of the present invention. Other modifications that can be employed can be within the scope of the invention. Thus, by way of example, but not of limitation, alternative configurations of the present invention can be utilized in accordance with the teachings herein. Accordingly, embodiments of the present invention are not limited to that precisely as shown and described.

We claim:

1. A headset having a first and a second audio playing modes, comprising:

a headband component, wherein the headband component has a bottom surface and a top surface, and wherein the headband component comprises a first end and a second end;

two external earpieces, wherein each earpiece is configured to cover one ear of a user and is connected to one of the first end and second end of the headband component, and wherein each earpiece includes a built-in speaker;

two external speaker components, wherein each external speaker component has a predetermined design, wherein each external speaker component has a bottom dimension smaller than the width of the top surface of the headband component and is mounted thereon above the first end and second end and not in contact with the head; and a control switch to change between the first and second audio playing modes, wherein:

in the first audio playing mode, at least one built-in speaker of the two external earpiece and at least one of the external speaker components are turned on, and in the second audio playing mode, either at least one built-in speaker of the two external earpieces or at least one of the external speaker components is turned on.

2. The headset of claim 1, wherein the predetermined design is selected from the group consisting of a cat ear, a bear ear, a hare ear, a horoscope design, a zodiac design, a non-ear shaped design, a flower, a star, a leaf, a Christmas tree design, and combinations thereof.

3. The headset of claim 1, wherein each of the one or two external earpieces has a decorative element on the side that is opposite to the side coving the ear.

4. The headset of claim 3, wherein the decorative element comprises one or more light emitting diode (LED) rings.

5. The headset of claim 4, wherein at least one of the one or more LED rings on the external earpieces flashes with the music when the headset is used to listen to music.

6. The headset of claim 5, wherein the flashing of the at least one of the one or more LED rings on the external earpieces is synchronized with the beat of the music.

7. The headset of claim 1, wherein each of the two external speaker components has a decorative element.

8. The headset of claim 7, wherein the decorative element comprises one or more light emitting diode (LED) lights.

9. The headset of claim 8, wherein at least one of the one or more LED lights on the external speaker components flash with the music when the headset is used to listen to music.

10. The headset of claim 9, wherein the flashing of the at least one of the one or more LED rings on the external speaker components is synchronized with the beat of the music.

11. The headset of claim 8, wherein at least one of the one or more LED lights on the external speaker components emits multiple colors.

12. The headset of claim 8, wherein at least one of the one or more LED lights on the external speaker components is configured to change its color.

13. The headset of claim 1, further comprising:

one or more control button on the headband component.

14. The headset of claim 1, further comprising:

one or more control button on the one or more external earpieces.

15. The headset of claim 1, further comprising:

one or more control button on one of the two external speaker components.

16. The headset of claim 1, further comprising:

an audio cable for receiving audio signals from an external device.

17. The headset of claim 1, further comprising:

a wireless communication unit for receiving audio signals wirelessly from an external device.

18. The headset of claim 17, wherein the wireless communication unit is located in one selected from the group consisting of a headband component, an external earpiece, an external speaker component, and combinations thereof.

19. The headset of claim 1, further comprising a microphone.

20. The headset of claim 1, wherein the external speaker components are removably mounted on the top surface of the headband component via a reversible attachment motif that allows at last one external speaker component to be functionally replaced with an external speaker of a different design.

21. The headset of claim 20, wherein the attachment motif comprises one or more attachment elements on the external speakers and one or more receiving elements on the top surface of the headband component.

22. The headset of claim 21, wherein the one or more attachment elements and the one or more receiving elements form at least one electric connection.

23. The headset of claim 20, wherein external speaker components with different predetermined designs comprise the same one or more attachment elements.

24. The headset of claim 1, wherein each of the one or two external ear pieces has a decorative element on the side that is opposite to the side coving the ear.

25. The headset of claim 24, wherein the decorative element comprises one or more light emitting diode (LED) rings.

26. The headset of claim 25, wherein at least one of the one or more LED rings on the external earpieces flashes with the music when the headset is used to listen to music.

27. A headset having a first and a second audio playing modes, comprising:

a headband component, wherein the headband component has a bottom surface and a top surface, and wherein the headband component comprises a first end and a second end;

two external earpieces, wherein each earpiece is configured to cover one ear of a user and is connected to one of the first end and second end of the headband component, and wherein each earpiece includes a built-in speaker; and two external speaker components, wherein each external speaker component has a predetermined design, wherein each external speaker component has a bottom dimension smaller than the width of the top surface of the headband component and is mounted thereon above the first end and second end, and configured to broadcast when mounted to the headband, and wherein the external speaker components are removably mounted on the top surface of the headband component via a reversible attachment motif that allows at last one external speaker component to be functionally replaced with an external speaker of a different design.

28. The headset of claim 27, further comprising:

a wireless communication unit for receiving audio signals wirelessly from an external device.

29. The headset of claim 28, wherein the wireless communication unit is located in one selected from the group consisting of a headband component, an external earpiece, an external speaker component, and combinations thereof.

30. The headset of claim 27, wherein the predetermined design is selected from the group consisting of a cat ear, a bear ear, a hare ear, a horoscope design, a zodiac design, a non-ear shaped design, a flower, a star, a leaf, a Christmas tree design, and combinations thereof.

31. The headset of claim 27, wherein each of the two external speaker components has a decorative element.

32. The headset of claim 31, wherein the decorative element comprises one or more light emitting diode (LED) lights.

33. The headset of claim 32, wherein at least one of the one or more LED lights on the external speaker components flash with the music when the headset is used to listen to music.

34. A headset having a first and a second audio playing modes, comprising:

a headband component, wherein the headband component has a bottom surface and a top surface, and wherein the headband component comprises a first end and a second end;

two external earpieces, wherein each earpiece is configured to cover one ear of a user and is connected to one of the first end and second end of the headband component, and wherein each earpiece includes a built-in speaker;

at least one external speaker component, wherein the at least one external speaker component has a predetermined design, wherein the at least one external speaker component has a bottom dimension smaller than the width of the top surface of the headband component and is mounted thereon above the first end and second end and configured to broadcast when mounted to the headband; and a control switch to change between the first and second audio playing modes, wherein:

in the first audio playing mode, at least one built-in speaker of the two external earpieces and at least one of the external speaker components are turned on, and in the second audio playing mode, either at least one built-in speaker of the two external earpieces or at least one of the external speaker components is turned on.

35. A headset having a first and a second audio playing modes, comprising:

a headband component, wherein the headband component has a bottom surface and a top surface, and wherein the headband component comprises a first end and a second end;

two external earpieces, wherein each earpiece is configured to cover one ear of a user and is connected to one of the first end and second end of the headband component, and wherein each earpiece includes a built-in speaker; and at least one external speaker component, wherein the at least one external speaker component has a predetermined design, wherein the at least one external speaker component has a bottom dimension smaller than the width of the top surface of the headband component and is mounted thereon above the first end and second end and configured to broadcast when mounted to the headband, and wherein the at least one external speaker component is removably mounted on the top surface of the headband component via a reversible attachment motif that allows at last one external speaker component to be functionally replaced with an external speaker of a different design.

* * * * *